US005181627A

United States Patent [19]

McDermott et al.

[11] Patent Number: 5,181,627

[45] Date of Patent: * Jan. 26, 1993

[54] BASKET LINER

[76] Inventors: Susan M. McDermott, 12216 Izard St., Omaha, Nebr. 68154; Mary J. Ellis, 1405 North 127th Cir., Omaha, Nebr. 68154

[ * ] Notice: The portion of the term of this patent subsequent to Mar. 24, 2009 has been disclaimed.

[21] Appl. No.: 842,217

[22] Filed: Feb. 26, 1992

Related U.S. Application Data

[63] Continuation-in-part of Ser. No. 690,109, Apr. 23, 1991, Pat. No. 5,097,979.

[51] Int. Cl.[5] ..... B65D 90/04

[52] U.S. Cl. ..... 220/404; 220/470; 217/3 R

[58] Field of Search ..... 220/9.1, 403, 404, 470, 220/400, 401; 217/3 R, 125; 383/33

[56] References Cited

U.S. PATENT DOCUMENTS

| | | | |
|---|---|---|---|
| 1,465,367 | 8/1923 | Schwartz | 220/404 |
| 1,653,556 | 12/1927 | Faber | 220/404 |
| 2,610,757 | 9/1952 | Irvine | 220/9 |
| 3,349,936 | 10/1967 | Morton et al. | 220/470 |
| 4,993,551 | 2/1991 | Lindsay | 383/39 |
| 5,097,979 | 3/1992 | McDermott et al. | 220/404 |

*Primary Examiner*—Allan N. Shoap
*Assistant Examiner*—Jes F. Pascia
*Attorney, Agent, or Firm*—Zarley, McKee, Thomte Voorhees & Sease

[57] ABSTRACT

A basket liner is designed for use with various types of baskets. A first liner is designed for a basket with a single handle, and includes a sheet of fabric with forward and rearward edges, and opposing side edges. The forward and rearward edges of the fabric are wrapped around the forward and rearward legs of the handle, and fastened in place to connect the liner to the basket. Another embodiment of the invention is designed for use with baskets of the type having two handles thereon. In this type of basket liner, the fabric sheet has a pair of first and second aligned cuts in the front and rear edges of the sheet, and a second pair of aligned third and fourth cuts spaced from the first and second cuts, in the front and rear edges of the sheet.

7 Claims, 8 Drawing Sheets

BASKET LINER

CROSS-REFERENCE TO RELATED APPLICATION

This is a continuation-in-part application of Ser. No. 07/690,109 filed Apr. 23, 1991 now U.S. Pat. No. 5,097,979.

BACKGROUND OF THE INVENTION

Baskets have been utilized for centuries for the transportation and display of various products. It is, therefore, desirable to provide lining for such baskets, so as to create decorative alternatives for the consumer.

It is therefore a general object of the present invention to provide an improved basket liner.

Another object of the present invention is to provide a basket liner which may be anchored into position.

Yet another object of the present invention is to provide a basket liner with anchors which are decorative in nature.

Yet another object is to provide a basket liner which is simple and economical to manufacture.

Still another object of the present invention is to provide a basket liner which is quick and simple to utilize.

These and other objects will be apparent to those skilled in the art.

SUMMARY OF THE INVENTION

The basket liner of the present invention is designed for use with various types of baskets. A first liner is designed for a basket with a single handle, and includes a sheet of fabric with forward and rearward edges, and opposing side edges. The forward and rearward edges of the fabric are wrapped around the forward and rearward legs of the handle, and fastened in place to connect the liner to the basket. In one embodiment of the invention the wrapped portion of the sheet edges are fastened in position with a ribbon wrapped around the wrapped portion of each leg and tied in a bow. Many alternative methods for fastening the wrapped portion of the front and rear edges of the sheet are provided in the various embodiments of the invention. Another embodiment of the invention is designed for use with baskets of the type having two handles thereon. In this type of basket liner, the fabric sheet has a pair of first and second aligned cuts in the front and rear edges of the sheet, and a second pair of aligned third and fourth cuts spaced from the first and second cuts, in the front and rear edges of the sheet. The cuts in the sheet will form a flap between the cuts which extends between the two handles on the basket when the liner is placed in the basket. The opposing sides of each cut are provided with fasteners to fasten the cut together around each leg of each handle, to fasten the liner to the basket. BRIEF DESCRIPTION OF THE DRAWINGS FIG. 1 is a perspective view of the basket liner of the present invention mounted on a basket;

DESCRIPTION OF THE PREFERRED EMBODIMENTS

Figure 1:
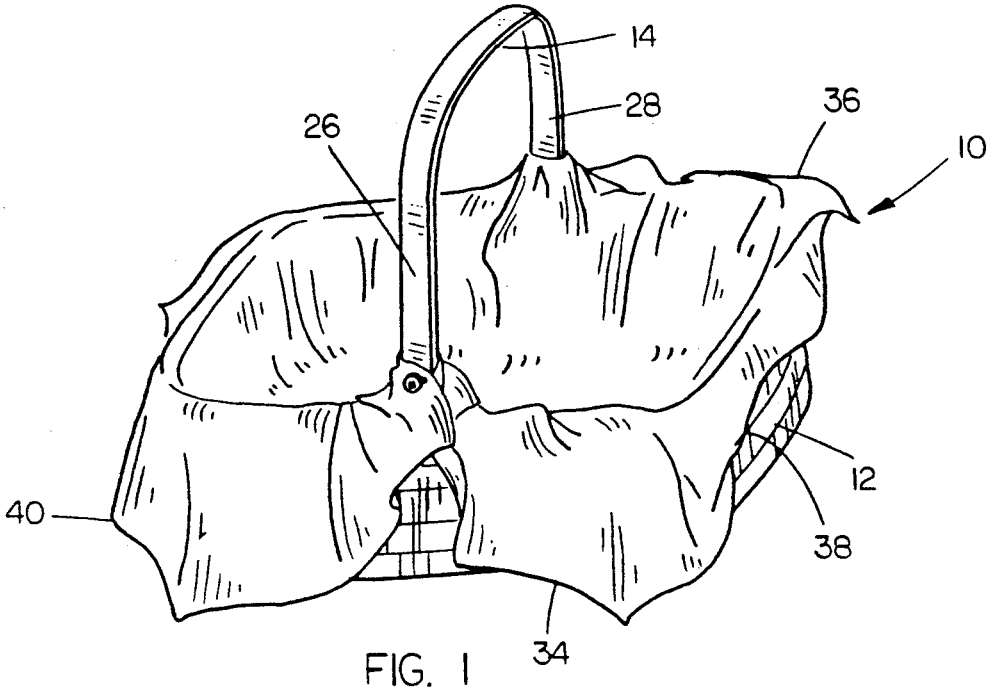

Referring now to the drawings, in which similar or corresponding parts are identified with the same reference numeral, and more particularly to FIG. 1, the basket liner of the present invention is designated generally at 10 and is shown fastened to a basket 12 having an upstanding handle 14.

Figure 3:
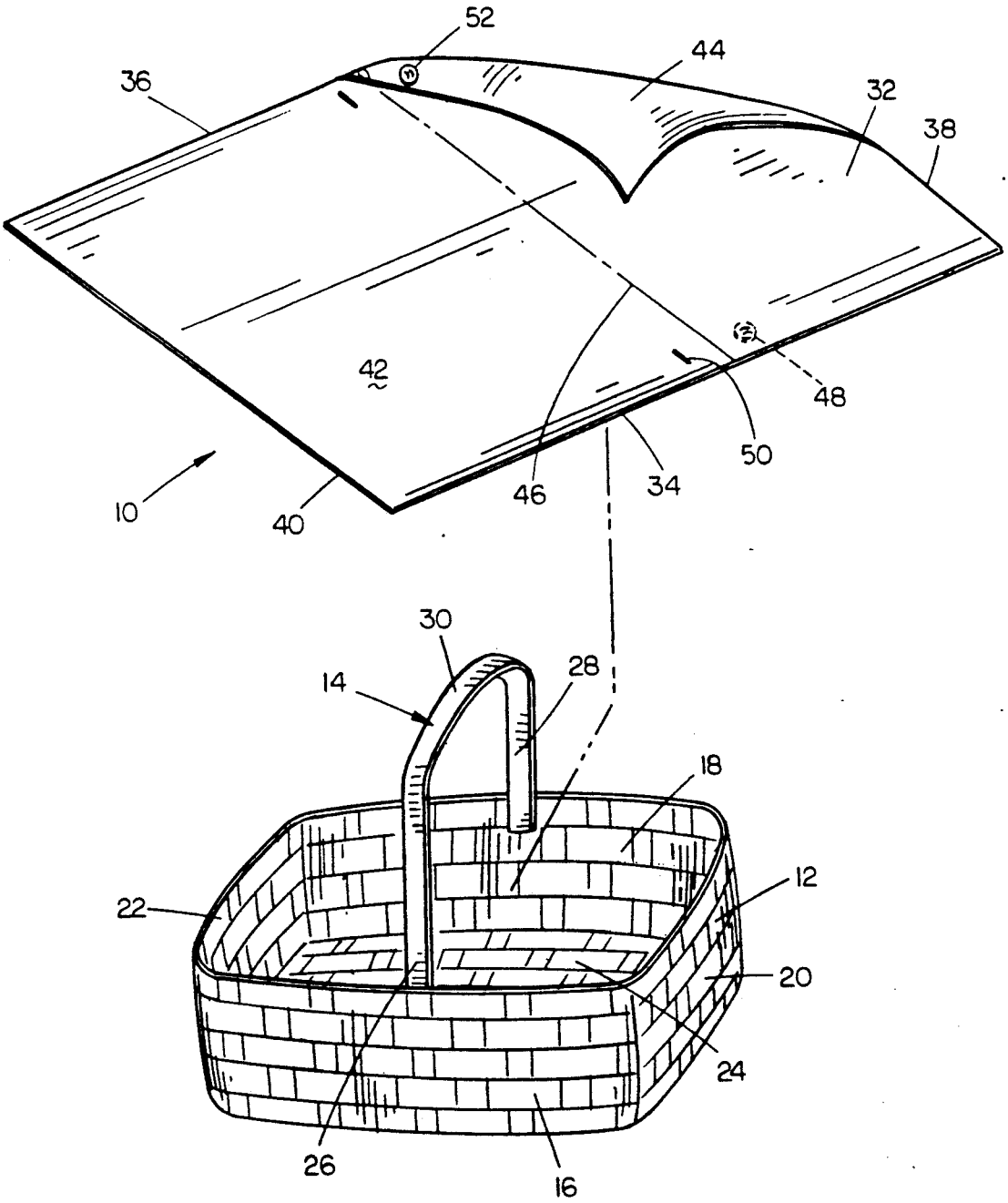
FIG. 3 is a perspective view of a basket with the basket liner of this invention removed therefrom.

Referring now to FIG. 3, basket 12 has forward and rearward upstanding panels 16 and 18 respectively, opposing upstanding side panels 20 and 22 and a bottom 24. Handle 14 includes a pair of legs 26 and 28 affixed to front and rear panels 16 and 18 respectively, and projecting upwardly therefrom Legs 26 and 28 are connected by a cross-member 30 to form generally U-shaped handle 14.

Basket liner 10 is formed from a generally rectangular sheet of fabric 32 and includes a forward edge 34, rearward edge 36 opposing side edges 38 and 40 an upper surface 42 and lower surface 44. A center line 46 is indicated on fabric sheet 32 and is located midway between side edges 38 and 40.

Preferably, fabric sheet 32 has a width, as measured along side edges 38 and 40, approximately equal to the height of front and rear panels 16 and 18 and the width of bottom 24 (as measured between front and rear panels 16 and 18) of basket 12. Similarly, it is preferred that the length of fabric sheet 32 is equal to the length of basket bottom 24 added to the height of side panels 20 and 22. In this way, when basket liner 10 is installed in basket 12, the respective edges 34, 36, 38 and 40 will drape over the sides of the basket, as shown in FIG. 1.

A button 48 is sewn to the lower surface 44 of fabric sheet 32 adjacent to and spaced slightly from forward edge 34 and adjacent but spaced slightly from center line 46, as shown in FIG. 3 A buttonhole 50 is formed in fabric sheet 32 and spaced the same distance from center line 46 but on the opposite side thereof, to receive button 48 when fabric sheet 32 is fastened to basket 12. A second button 52 is affixed to the lower surface 44 of sheet 32 directly opposite button 48, adjacent rear edge 36. A second buttonhole 54 is formed in sheet 32 adjacent rear edge 36 directly opposite buttonhole 50, to receive button 52 when sheet 32 is affixed to basket 12.

Figure 2:
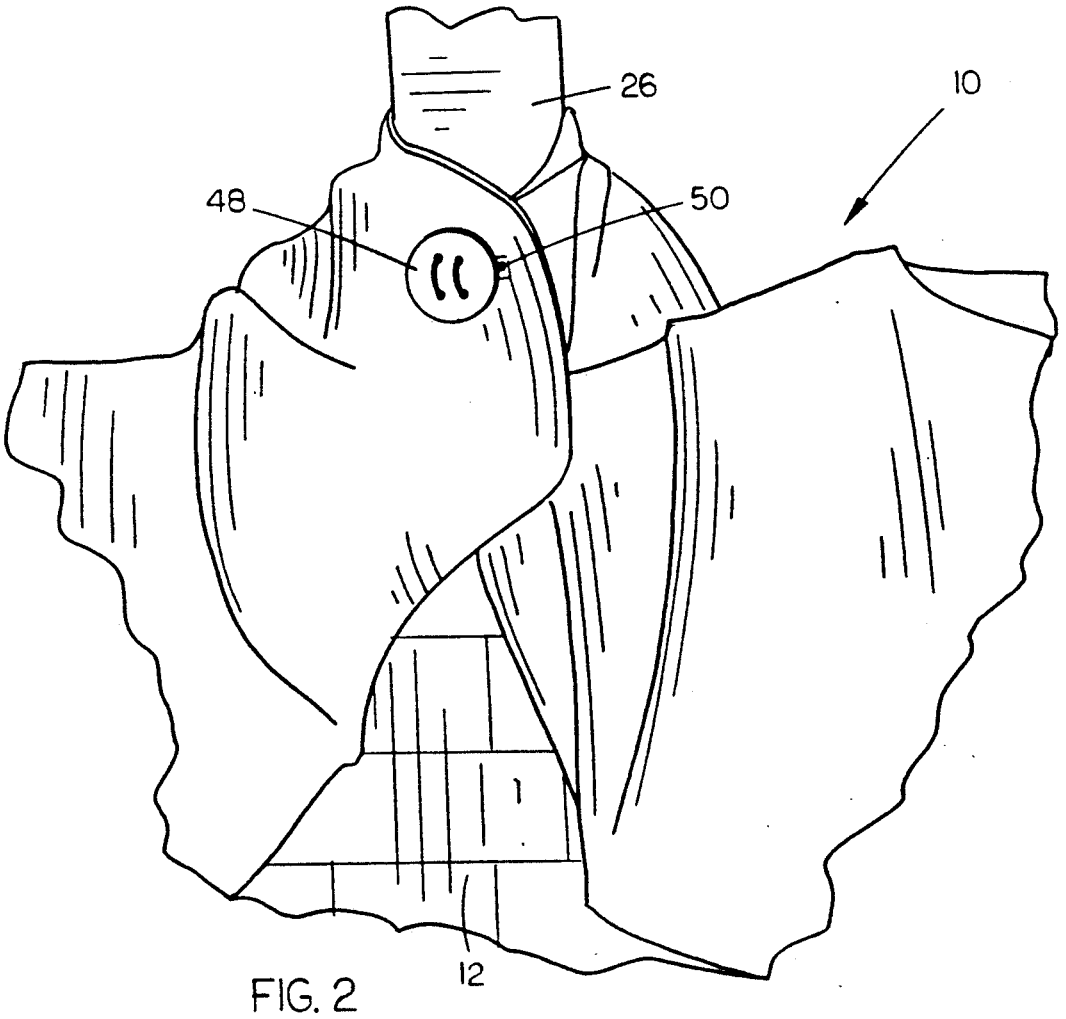
FIG. 2 is an enlarged perspective view of one anchor point of the liner to the basket of FIG. 1.

As shown in FIGS. 1 and 2, basket liner 10 is anchored to basket 12 by laying sheet 32 into basket 12 with the lower surface 44 contacting the bottom 24 of the basket. Button 48 will be facing forward panel 16, and a portion of forward edge 34 is wrapped around leg 26 of handle 14 so as to fasten button 48 through buttonhole 50 to anchor basket liner 10 to leg 26. A similar process is utilized with leg 28 of handle 14 to fasten basket liner 10 thereto.

Figure 4:
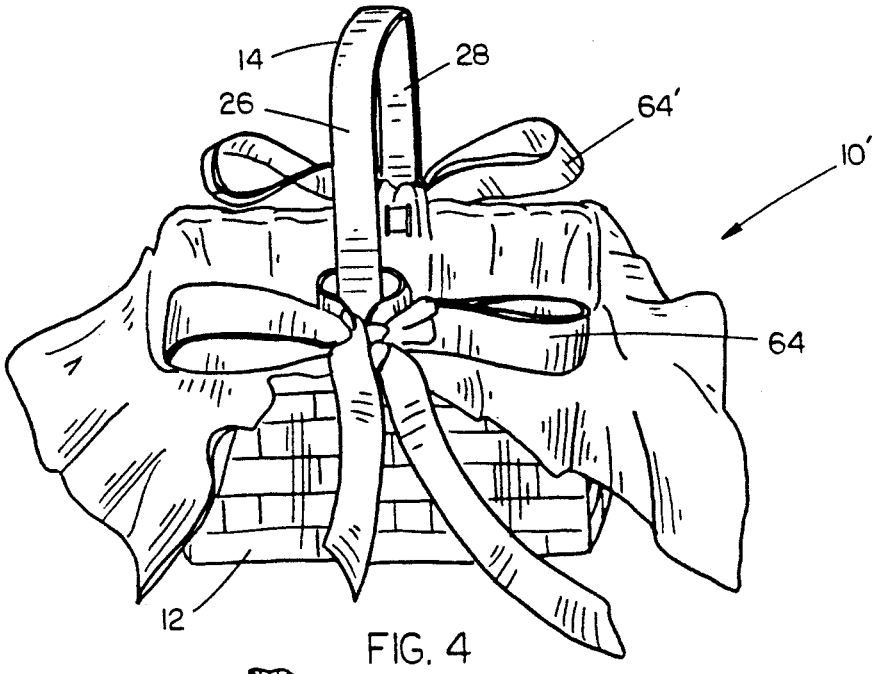
FIG. 4 is a perspective view of a second embodiment of the basket liner of the invention.
Figure 5:
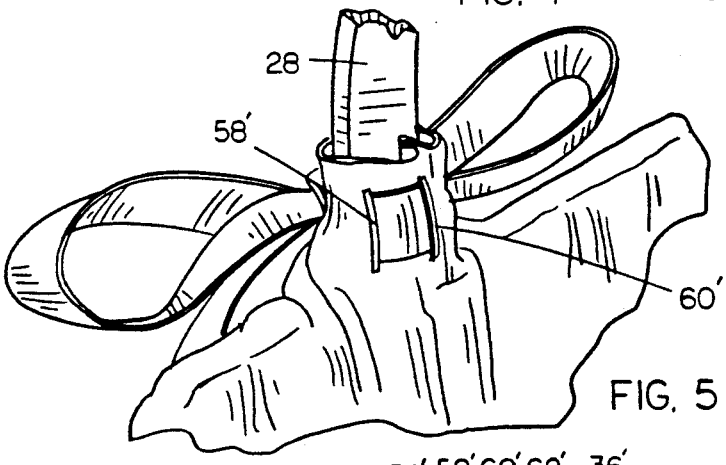
FIG. 5 is a enlarged perspective view of one anchor of the second embodiment of the invention.
Figure 6:
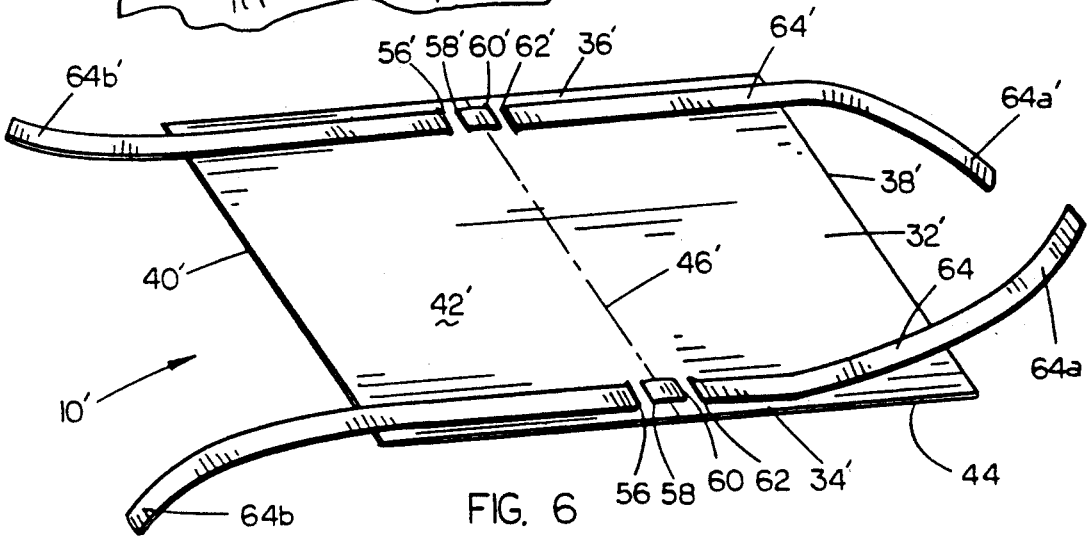
FIG. 6 is a perspective view of the second embodiment of the basket liner removed from the basket.

Referring now to FIGS. 4, 5 and 6, a second embodiment of the basket liner is designated generally at 10' which is designed for anchoring to basket 12. As shown in FIG. 6, basket liner 10' begins with a sheet 32' having the same dimensions as the sheet 32 of the first embodiment, and including forward and rearward edges 34' and 36', side edges 38' and 40' and upper and lower surfaces 42' and 44' respectively. A center line 46' is drawn on sheet 32' midway between side edges 38' and 40', merely for reference purposes.

Four buttonholes 56, 58, 60 and 62 are formed parallel to one another and spaced apart adjacent forward edge 34', with buttonholes 56 and 58 spaced equidistant away from center line 46' and opposite to buttonholes 60 and 62. A similar arrangement of buttonholes 56', 58', 60' and 62' are formed adjacent rear edge 36', as shown in FIG. 6.

An elongated strip of ribbon 64 is woven through buttonholes 56–62, downward through buttonhole 62 upward through buttonhole 60 downward through buttonhole 58 and thence upward through buttonhole 56 such that the ends **64*a* and 64*b* of the ribbon 64 extend along the upper surface 42' of sheet 32'. A second ribbon 64' is woven through buttonholes 56'–62' in the same fashion so as to be oriented parallel to ribbon 64**.

Basket liner 10' is anchored to basket 12 by laying the liner in the basket with the lower surface 44' thereof in contact with the bottom of the basket. The portion of sheet 32' adjacent each leg 26 and 28 of handle 14 is wrapped around the respective handle leg 26 and 28 and ribbons 64 and 64' are tied together so as to anchor sheet 32' in position, as shown in FIG. 4. FIG. 5 shows the interior face of leg 28 and shows that buttonholes 58' and 60' are located interiorly of leg 28 with the remaining buttonholes 56' and 62' (not seen in FIG. 5) located towards the outside of leg 28. Preferably, ribbons 64 and 64' are tied in bows or some other decorative fashion.

Figure 7:
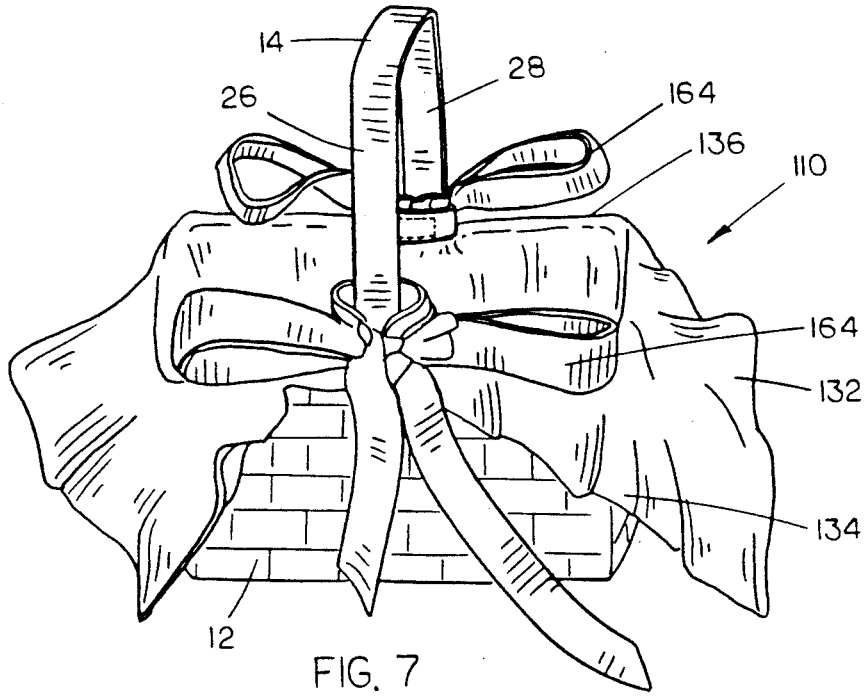
FIG. 7 is a perspective view of a third embodiment of the basket liner of the invention.
Figure 8:
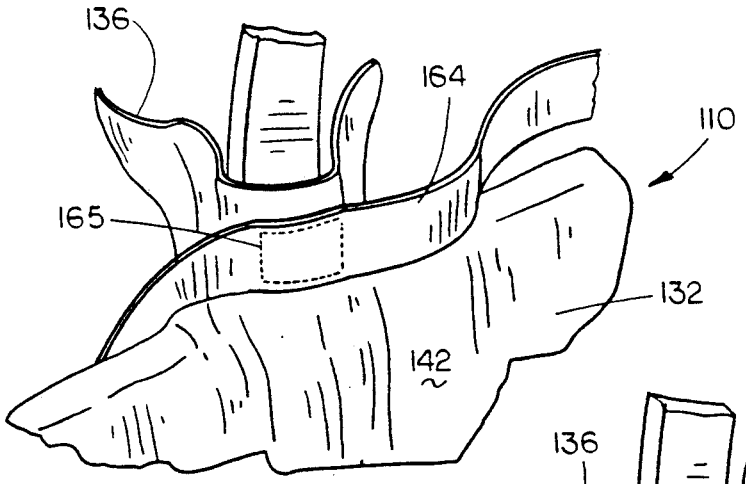
FIG. 8 is an enlarged perspective view of one anchor of the third embodiment of the invention.

Referring now to FIGS. 7 and 8, a third embodiment of the basket liner is designated generally at 110, and includes the same generally rectangular sheet 132 having the same dimensions as the sheet 32 of the first embodiment. Sheet 132 has forward and rearward edges 134 and 136 which will be anchored to upstanding legs 26 and 28 of basket handle 14, respectively.

An elongated strip of ribbon 164 is utilized to anchor sheet 132 to basket 12, in a fashion similar to that of the second embodiment shown in FIG. 4. However, rather than weaving the ribbon through slots, ribbon 164 is attached directly to the upper surface 142 adjacent forward and rearward edges 134 and 136. As shown in FIG. 8, ribbon 164 may be attached by stitching 165, or other equivalent method. Sheet 132 is then anchored to legs 26 and 28 by wrapping the associated edge 134 and 136 about the handle legs and tieing a bow with each ribbon 164, as shown in FIG. 7.

Figure 9:
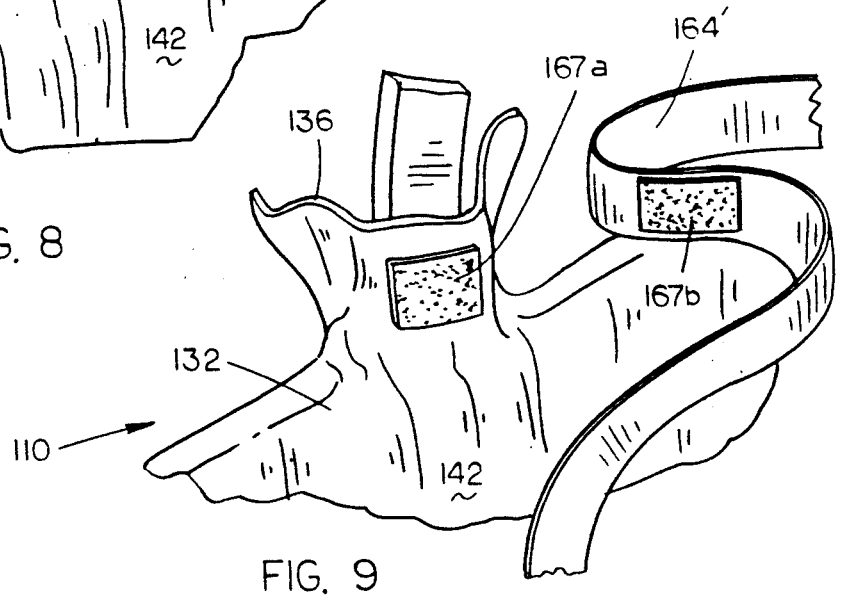
FIG. 9 is an enlarged perspective view similar to FIG. 8 showing a different anchor for the third embodiment of the invention.

FIG. 9 shows ribbon 164' removably attached to sheet 132 utilizing a first half **167*a* of a hook and loop fastener mounted adjacent edge 136 on the upper surface 142 of sheet 132. The second half 167*b* of the hook and loop fastener is mounted on ribbon 164'. In this way, ribbon 164' may be selectively removed from the sheet 132, to permit laundering of sheet 132, or the like. Selectively detachable ribbon 164' may also be exchanged for different colors or styles on a particular basket liner 110**, thereby providing greater variety.

Figure 10:
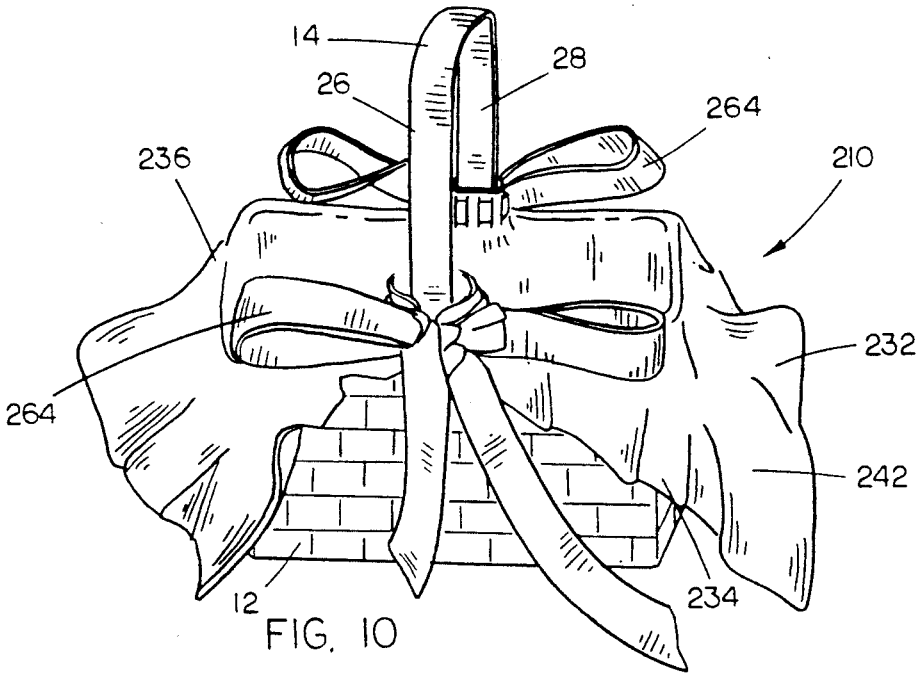
FIG. 10 is a perspective view of a fourth embodiment of the invention.
Figure 11:
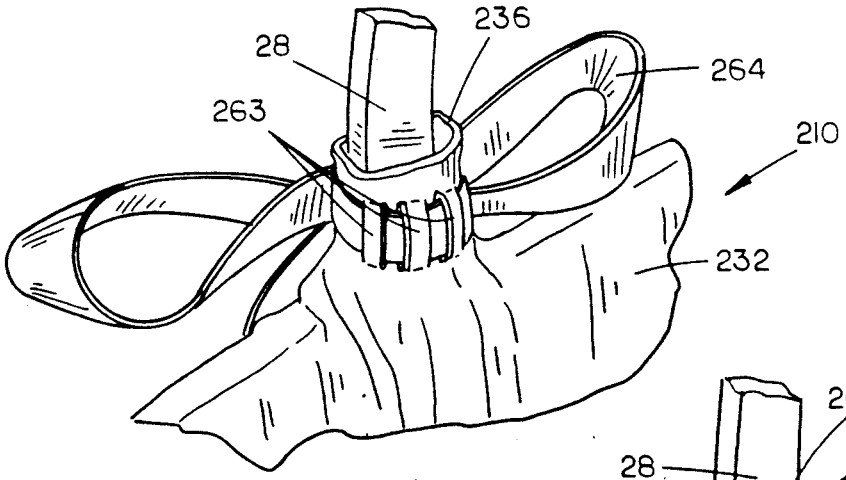
FIG. 11 is an enlarged perspective view of one anchor of the fourth embodiment of the invention.
Figure 12:
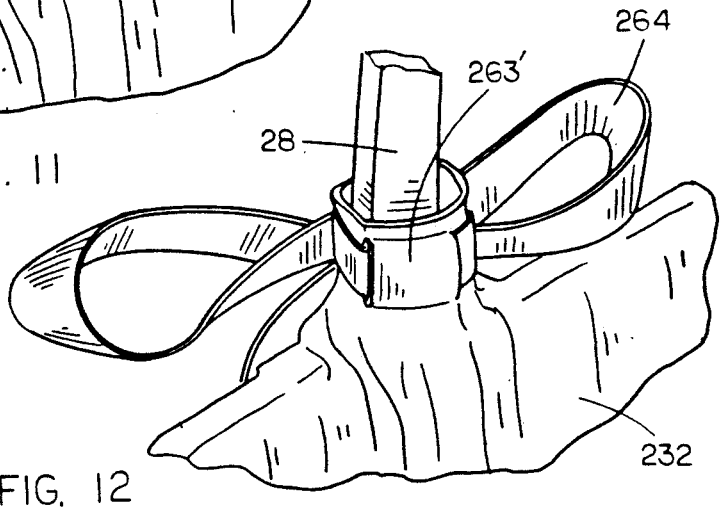
FIG. 12 is an enlarged perspective view of a different anchor of the fourth embodiment of the invention.

Referring now to FIGS. 10–12, a fourth embodiment of the invention is designated at 210 and includes a sheet 232 having a forward edge 234, rearward edge 236 and upper surface 242. As with the second and third embodiments, a ribbon 264 is connected to the upper surface 242 of sheet 232 adjacent forward and rearward edges 234 and 236 to anchor sheet 232 to legs 26 and 28 of handle 14 on basket 12.

In the fourth embodiment of the invention, as shown more particularly in FIG. 11, ribbon 264 is connected to sheet 232 by threading it through a series of spaced-apart loops 263, which are attached to the upper surface 242 of sheet 232 adjacent the forward and rearward edges 234 and 236 respectively. Loops 263 may be attached to sheet 232 by stitching, adhesive, or any similar method.

In addition, a single wide loop or tube 263' may be utilized in place of a series of narrower loops, as shown in FIG. 12.

Figure 13:
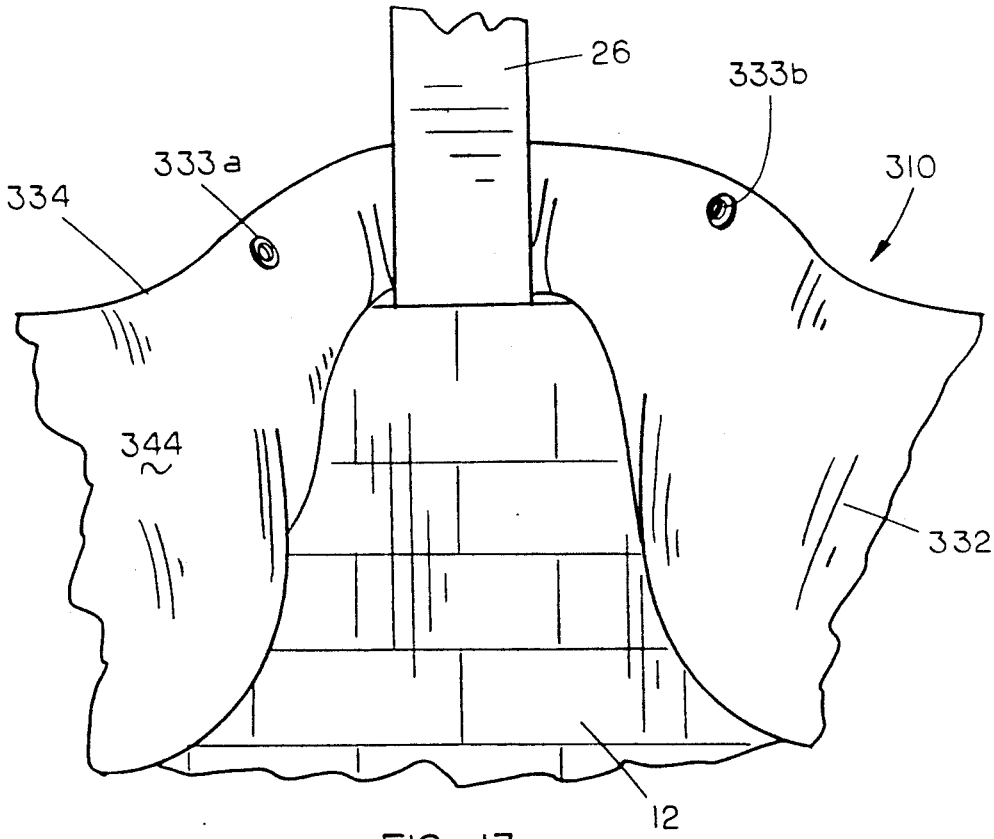
FIG. 13 is an enlarged perspective view of one anchor of a fifth embodiment of the invention.
Figure 14:
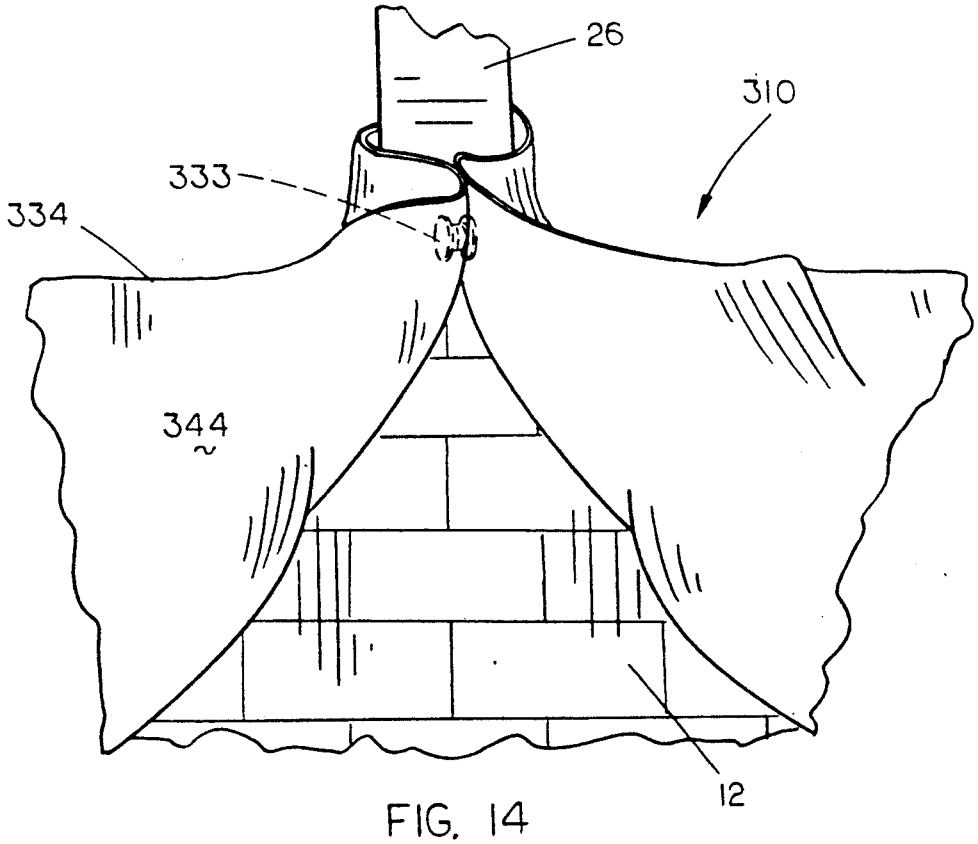
FIG. 14 is a view similar to 13 with the anchor fastened around the basket handle.

A fifth embodiment of the invention is designated generally at 310 in FIGS. 13 and 14. These figures show the front leg 26 of basket 12 with the forward edge 334 of sheet 332 anchored on leg 26. A first half **333*a* of a cooperable fastener is mounted on the lower surface 344 of sheet 332 adjacent forward edge 334. The second half 333*b* of the cooperable fastener is spaced-apart adjacent forward edge 334, and is also located on the lower surface 344 of sheet 332. In this fashion, fastening fastener halves 333*a* and 333*b*, as shown in FIG. 14, will bring the lower surface 344 in abutting contact around leg 26 along forward edge 334. A similar arrangement is utilized on the opposite side to anchor the sheet to rearward leg 28 (not shown). Although fastener 333** is shown as a snap in the drawings, it could be any equivalent fastener, such as hook and loop fastener, or a cuff link type fastener inserted through a pair of slots in the fabric.

Figure 15:
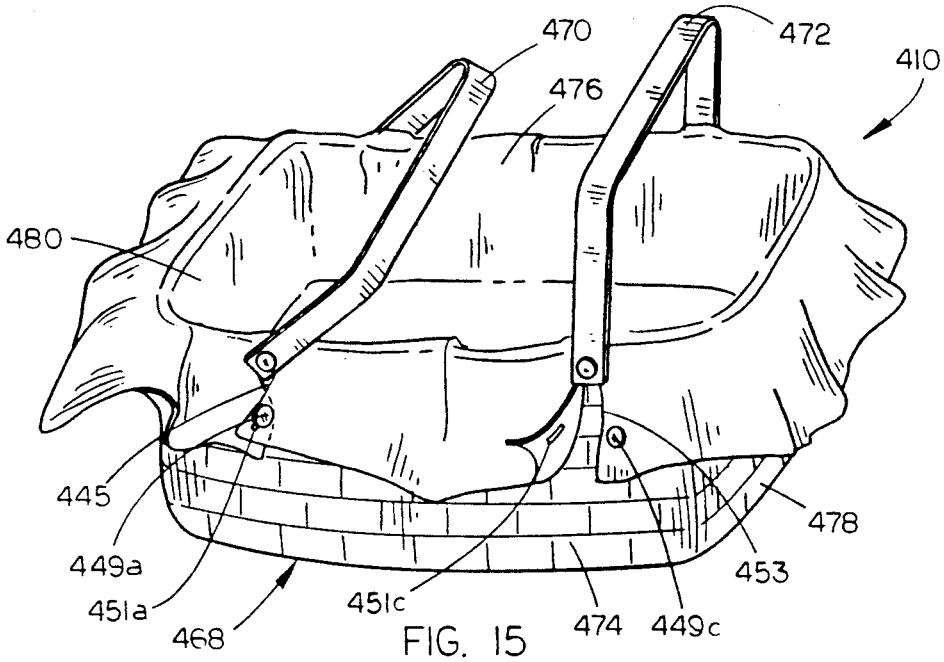
FIG. 15 is a perspective view of a sixth embodiment of the invention.
Figure 16:
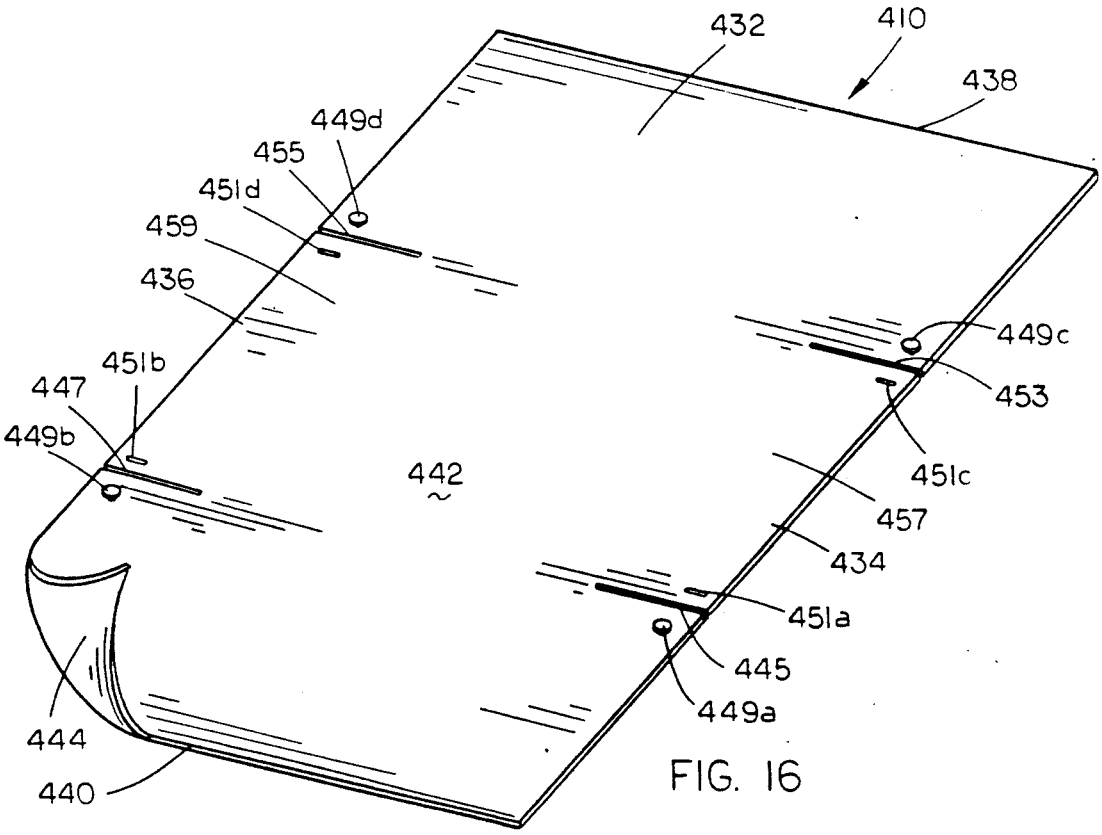
FIG. 16 is a perspective view of the basket liner of the sixth embodiment removed from the basket.
Figure 17:
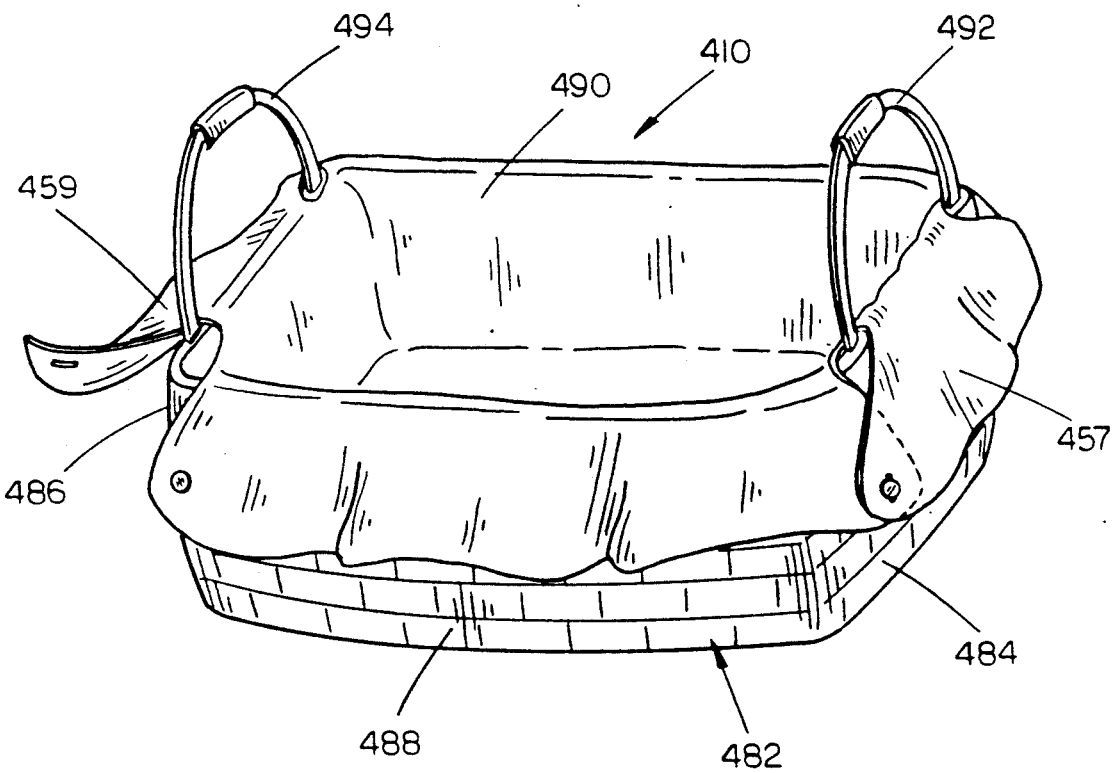
FIG. 17 is a perspective view of the sixth embodiment of the invention modified for a different type of basket.

A sixth embodiment of the invention is designated generally at 410 in FIGS. 15–17. Basket liner 410 is designed for a basket 468 having at least two handles 470 and 472. Basket 468 includes a front panel 474 rearward panel 476 (not shown) and a pair of side panels 478. Handles 470 and 472 are connected between forward and rearward panels 474 and 476, and are pivotable so that they may be laid flat to the outside of side panels 478 and 480.

Since handles 470 and 472 pivot, it is not possible to wrap basket liner 410 about the handle legs to anchor the basket liner in position. Preferably, liner 410 includes a fabric sheet 432 having a front edge 434 rearward edge 436 side edges 438 and 440 and upper and lower surfaces 442 and 444.

A first pair of cuts 445 and 447 are formed in forward and rearward edges 434 and 436, in alignment with one another. Cuts 445 and 447 extend inwardly towards one another a distance approximately equal to the length of sheet 432 which will drape over the sides of front and rear panels 474 and 476 of basket 468. In this way, the inner end of slots 445 and 447 will wrap around the pivotal connection of the legs of handle 470 to front and rear panels 474 and 476. A button 449*a* and associated buttonhole 451*a* are arranged on opposite sides of cut 445 adjacent forward edge 434 of sheet 432 so as to enclose the leg of handle 470 in cut 445, as shown in FIG. 15. Similarly, a button 449*b* and buttonhole 451*b* are arranged adjacent rearward edge 436 on opposite sides of cut 447.

A third and fourth cut 453 and 455 are formed in forward and rearward edges 434 and 436 spaced apart from cuts 445 and 447 and associated with the location of handle 472. Cuts 453 and 455 extend inwardly and are in alignment with one another so as to receive the legs of handle 472 in a similar fashion as cuts 445 and 447 receive handle 470. A button 449*c* and associated buttonhole 451*c* are arranged on opposing sides of cut 453 adjacent edge 434, and a similar button 449*d* and buttonhole 451*d* are located on opposite sides of cut 455.

As shown in the drawings, cuts 445 and 453 serve to form a type of flap 457 along forward edge 434 which will drape down against front panel 474 of basket 468 between handles 470 and 472 Flap 457 is connected to the adjacent portions of the forward edge 434 by the button and buttonhole combination adjacent each cut. A similar flap 459 is formed along rearward edge 436, as shown in FIG. 16. Cuts 445, 447, 453 and 455 are preferably made without removing material from sheet 432, such that fastening of the various buttons in the associated buttonholes will completely cover the sides of the basket over which the basket liner 410 is draped, while permitting pivotal movement of handles 470 and 472.

Yet another type of basket is designated generally at 482 in FIG. 17, and includes a forward panel 484, rearward panel 486 and side panels 488 and 490. Basket 482 includes a forward handle 492 having both legs connected to the upper edge of forward panel 484. A second handle 494 is mounted with both legs connected to rearward panel 486. It can be seen that basket liner 410 is arranged with forward flap 457 projecting through handle 492 and draped over front panel 484, with rearward flap 459 journaled through handle 494 against rearward panel 486. In this way, basket liner 410 permits the lining of a basket with two fixed handles at opposing ends of the basket.

Whereas the invention has been shown and described in connection with the preferred embodiments thereof, it will be understood that many modifications, substitutions and additions may be made which are within the intended broad scope of the appended claims. For example, the dimensions of the basket liner may be greater than the inner dimensions of the basket, to create additional overlapping edges. While a button is shown in the first embodiment of the invention, other types of fasteners may be utilized to anchor the basket liner in position on the legs of the handle.

There has therefore been shown and described an improved basket liner which accomplishes at least all of the above stated objects.

We claim:

1. In combination:

a basket having front and rear upstanding panels, opposing upstanding first and second side panels, a bottom, and a handle having a front leg projecting upward from said front panel and a second leg projecting upward from said rear panel;

said front leg having an inward face, an opposing outward face, and opposing right and left sides, said second leg having an inward face, an opposing outward face, and opposing right and left sides, a basket liner connected to said basket handle, comprising:

a sheet of fabric having front and rear edges, opposing first and second side edges, an upper surface and a lower surface;

first means adjacent the front edge of said sheet for connecting said sheet to said first leg of said handle;

said first connecting means including a portion of said front edge of said sheet wrapped around said first leg with a right portion extending outwardly around the right side of the front leg and a left portion extending outwardly around the left side of the front leg, and first fastener means for connecting the right and left portions of the wrapped portion of the front edge together adjacent the outward face of the front leg;

second means adjacent to the rear edge of said sheet for connecting said sheet to said second leg of said handle; and said second connecting means including a portion of said rear edge of said sheet wrapped around said second leg with a right portion extending outwardly around the right side of the second leg and a left portion extending outwardly around the left side of the second leg, and second fastener means for connecting the right and left portions of the wrapped portion of the rear edge together adjacent the outward face of the second leg.

2. The combination of claim 1, wherein:

said first fastener means includes a first ribbon having first and second ends attached intermediate its ends to said sheet adjacent the front edge;

the ends of said first ribbon wrapped around the wrapped portion of the front leg, and connected together;

said second fastener means includes a second ribbon having first and second ends attached intermediate its ends to said sheet adjacent the rear edge;

the ends of said second ribbon wrapped around the wrapped portion of the rear leg, and connected together.

3. The combination of claim 2, further comprising means for removably attaching said first and second ribbons to the sheet adjacent the first and second edges.

4. The combination of claim 3, wherein said means for removably attaching said ribbons includes:

a first cooperable fastener having first and second halves, the first half of the fastener mounted on said sheet adjacent the front edge, and the second half of the fastener mounted on said first ribbon; and a second cooperable fastener having first and second halves, the first half mounted on said sheet adjacent the rear edge, and the second half mounted on said second ribbon.

5. The combination of claim 3, wherein said means for removably attaching said ribbons includes:

a first loop mounted adjacent the front edge of the sheet, with said first ribbon threaded therethrough; and a second loop mounted adjacent the rear edge of the sheet, with said second ribbon threaded therethrough.

6. The combination of claim 1, wherein:

said first fastener means includes a first fastener having cooperable first and second halves, the first half connected to said sheet adjacent the front edge, and the second half connected to said sheet adjacent the front edge and spaced from said first half; and said second fastener means includes a second fastener having cooperable first and second halves, the first half connected to said sheet adjacent the rear edge, and the second half connected to sheet adjacent the rear edge and spaced from the first half.

7. The combination of claim 1, wherein:

said first fastener means includes a first pair of spaced-apart apertures formed adjacent said front edge, and a first fastener threaded through both of said first apertures to connect the portions of the front edge at said first apertures; and said second fastener means includes a second pair of spaced-apart apertures formed adjacent said rearward edge, and a second fastener threaded through both of said second apertures to connect the portions of the rearward edge at said second apertures.

* * * * *